US008974133B2

(12) United States Patent
Schreitter Ritter von Schwarzenfeld

(10) Patent No.: US 8,974,133 B2
(45) Date of Patent: Mar. 10, 2015

(54) DISPENSING DEVICE WITH AN ELECTRIC MOTOR

(75) Inventor: Thomas Schreitter Ritter von Schwarzenfeld, Korschenbroich (DE)

(73) Assignee: Verwaltungsgesellschaft Fuggerstrasse GBR, Korschenbroich (DE)

( * ) Notice: Subject to any disclaimer, the term of this patent is extended or adjusted under 35 U.S.C. 154(b) by 782 days.

(21) Appl. No.: 13/014,331

(22) Filed: Jan. 26, 2011

(65) Prior Publication Data

US 2011/0248053 A1 Oct. 13, 2011

(30) Foreign Application Priority Data

Jan. 28, 2010 (DE) ..... 20 2010 001 508 U
Aug. 24, 2010 (DE) ..... 20 2010 011 769 U

(51) Int. Cl.

| | |
|---|---|
| ***B43K 29/00*** | (2006.01) |
| ***B05C 17/01*** | (2006.01) |
| ***B05C 17/005*** | (2006.01) |
| ***B05C 17/015*** | (2006.01) |
| *B05B 1/16* | (2006.01) |

(52) U.S. Cl.

CPC ..... *B05C 17/0103* (2013.01); *B05C 17/00516* (2013.01); *B05C 17/00583* (2013.01); *B05C 17/015* (2013.01); *B05B 1/1636* (2013.01)

USPC ..... 401/193; 401/48; 401/137; 401/265

(58) Field of Classification Search

CPC .... B05B 1/1672; B05C 5/0233; B05C 5/027; B05C 5/275; B05C 5/279

USPC ..... 401/265, 28, 193, 48, 263, 137, 5, 136, 401/138, 139, 261, 14; 239/563, 562

See application file for complete search history.

(56) References Cited

U.S. PATENT DOCUMENTS

| | | | | |
|---|---|---|---|---|
| 3,182,867 | A * | 5/1965 | Barosko et al. | 239/563 |
| 4,932,565 | A * | 6/1990 | Paradiso | 401/193 |
| 5,381,964 | A * | 1/1995 | Reyna | 239/566 |
| 5,947,346 | A * | 9/1999 | London | 239/563 |
| 5,984,557 | A * | 11/1999 | Fennell | 401/193 |
| 6,981,611 | B2 * | 1/2006 | Carruth et al. | 222/1 |
| 2003/0197075 | A1 * | 10/2003 | Sano | 239/562 |

FOREIGN PATENT DOCUMENTS

| | | | |
|---|---|---|---|
| DE | 2101800 | | 7/1972 |
| DE | 2155427 | | 5/1973 |
| EP | 1439009 | | 7/2004 |
| WO | 2008/058911 | | 5/2008 |
| WO | WO 2008058911 | * | 5/2008 |

* cited by examiner

*Primary Examiner* — David Walczak
*Assistant Examiner* — Bradley Oliver
(74) *Attorney, Agent, or Firm* — Berenato & White, LLC

(57) ABSTRACT

The present invention relates to a dispensing device (1) for dispensing glue or adhesive onto a substrate surface for the laying of floor coverings, in particular parquet or laminate in board format, comprising a glue cylinder (103) into which at least one pouch filled with glue or adhesive can be inserted, and comprising a plunger (10) which is disposed such as to be axially displaceable within the glue cylinder (103) so as to compress a pouch located within the glue cylinder (103) and so to push its contents out of the glue cylinder (103), an electric drive (9) being provided which is coupled to the plunger (10) in order to displace the plunger (10) axially within the glue cylinder (103).

13 Claims, 4 Drawing Sheets

DISPENSING DEVICE WITH AN ELECTRIC MOTOR

CROSS-REFERENCE TO RELATED APPLICATIONS AND CLAIM TO PRIORITY

Figure 1A:
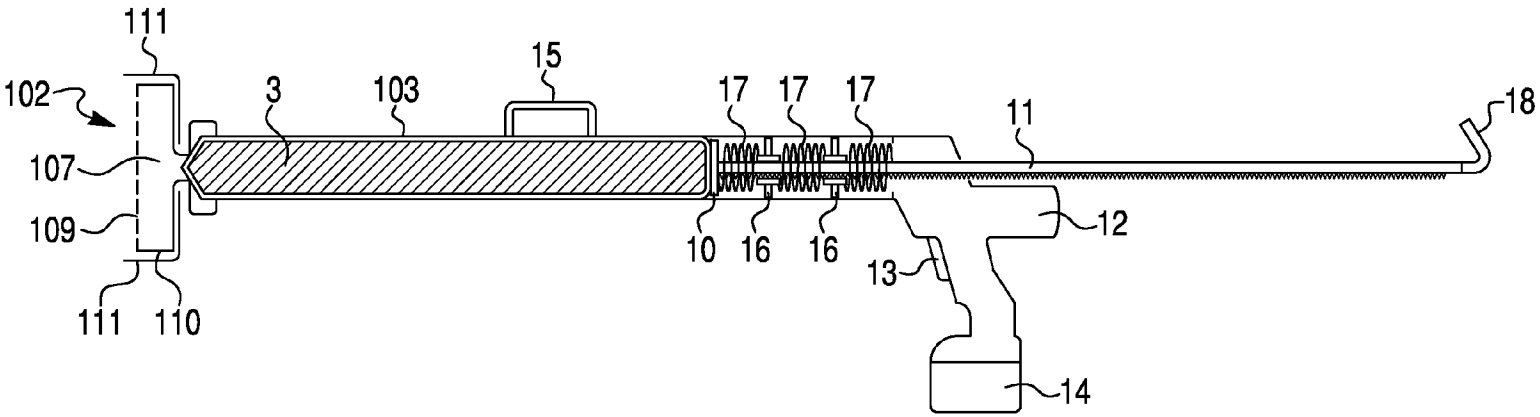

This application relates to German Application No. 20 2010 001 508.1 filed Jan. 28, 2010 and German Application No. 20 2010 011 769.0 filed Aug. 24, 2010, of which the disclosures are incorporated herein by reference and to which priority is claimed.

The present invention relates to a dispensing device for dispensing glue or adhesive in the width of the elements to be laid onto an area for the laying of floor coverings, in particular parquet or laminate inboard format, comprising a glue cylinder into which at least one pouch filled with glue or adhesive can be inserted, and comprising a plunger which is disposed displaceably and with axial movement within the glue cylinder so as to compress a pouch located within the glue cylinder and so to push its contents out of the glue cylinder. Furthermore, the present invention relates to a dispensing bar for dispensing glue or adhesive, in particular onto a substrate surface, in the width of floor coverings to be laid in board formats, comprising a base element on which at least one delivery opening and a number of dispensing openings are formed arranged lying next to one another, and in particular opposite the delivery opening.

These types of dispensing device are already sufficiently well known from the prior art, and are described, for example, in European Patent Application EP 1 439 009 A1. The device known from this publication includes two glue cylinders which serve to accommodate pouches filled with glue or adhesive. Disposed respectively in the glue cylinders is a plunger that can be moved by means of compressed air in order to compress the pouch located within the glue cylinder and so press its contents out of the pouches and deliver it by means of access openings of a dispensing bar. In order to deliver and distribute the glue, discrete channels coming off of the delivery opening are formed in the dispensing bar which open out into outlet openings formed on the dispensing bar opposite the delivery opening.

It is a disadvantage with the known prior art that it is expensive to produce these dispensing bars. Cleaning after dispensing glue is also complex and so costly. If a dispensing bar is not cleaned sufficiently thoroughly after use there is a risk that individual dispensing openings of the dispensing bar will become clogged up. The result can be inhomogeneous glue or adhesive dispensing which can lead to uneven distribution of the glue or adhesive over the surface of the object to be glued.

It is a further disadvantage of the known dispensing bar that the dispensing width is also already determined when producing the bar. Therefore, in particular from aspects relating to handling and for a reproduceable, even working result for every board width a particular, very costly dispensing bar may be required.

The delivery of glue and adhesive by means of compressed air is not unproblematic either. On the one hand the measures to be taken in order to deliver the compressed air precisely through the dispensing device without the risk of leakage points occurring are very complex. On the other hand, control of the amount dispensed and the dispensing speed with which the glue or adhesive moves out of a dispensing bar adjoining the glue cylinder also proves to be difficult.

It is therefore the object of the present invention to provide a dispensing device and a dispensing bar which have a simple structural design and enable simple and precise handling of the glue or adhesive dispensing.

This object is initially achieved according to the invention with a dispensing device in that an electric drive is provided which is coupled to the plunger in order to displace the plunger axially.

By providing an electric drive the sealing measures required with a pneumatic drive can be dispensed with. Control of the dispensing quantity and speed can also be implemented simply by controlling the rotational speed of an electric motor disposed in the electric drive.

In one exemplary embodiment of the present invention the plunger is connected to a toothed rack guided with axial moveability, which extends into the glue cylinder and is coupled to an output shaft of the electric drive so that rotation of the output shaft is converted into movement in a straight line of the toothed rack.

It can be advantageous that the electric drive has a gearing mechanism, in particular planetary gearing, which engages with the toothed rack in order to convert rotatory movement of the electric drive into a straight line movement of the toothed rack. In this way homogeneous and smooth movement of the toothed rack and so of the plunger, is made possible, and this aids even dispensing of the glue or adhesive.

Particularly simple handling and refillability of the dispensing device is provided if the gears can be switched manually between an operating position, in which they engage with the toothed rack, and a filling position, in which free axial movement of the toothed rack within the planetary gears of the electric drive is possible. In the filling position, by means of the free axial movement of the toothed rack the latter, and so also the plunger, can be brought particularly quickly into an initial position in which filling of the glue cylinder is possible.

In order to stabilise the toothed rack disposed in the dispensing device, in a further exemplary embodiment stabilising means are provided on the toothed rack by means of which the toothed rack can be supported on a wall of the glue cylinder in order to counter bending of the toothed rack due, for example, to bending moments acting on the toothed rack.

For this purpose the stabilising means can be formed, for example, by cylinder discs moveable along the toothed rack.

In order to guarantee that the stabilising means are also distributed as evenly as possible over the extension of the toothed rack with a moveable arrangement, in one exemplary embodiment spacer elements are provided between the stabilising means for holding the stabilising means equidistantly along the toothed rack.

The spacer elements can be formed, for example, by spring elements, in particular by spiral springs, which are supported between the stabilising means.

Particularly simple control is produced by an operator if the electric drive has actuating means which when actuated by a user enable the rotational speed and/or the direction of rotation of an electric motor used in the electric drive to be set. The actuating means can be designed such that it enables graduated setting of the rotational speed.

Alternatively, an infinitely variable change to the rotational speed can also be provided by a corresponding design of the actuating means.

In order to provide simple and flexible use of the dispensing device, in one exemplary embodiment of the present invention the electric drive is provided with an accumulator which supplies the electric motor of the electric drive with current.

In the electric drive a control can be provided which limits the current consumption of the electric motor. If, therefore, a load to be overcome by the electric motor becomes too big to move on the toothed rack, for example because the axial movement of the toothed rack is blocked, upon reaching a settable maximum current consumption which correlates approximately to the load to be applied, further current consumption is blocked by the control in order to prevent bending of the toothed rack due to the loads acting on it from feed motion and axial blockade.

Particularly flexible usability of the dispensing device according to the invention is produced if a dispensing bar adjoining the glue cylinder is attached interchangeably to the glue cylinder. A dispensing width of the dispensing device and so adaptation of the latter to the floor covering to be glued is thus made possible simply by interchanging the dispensing bar.

In order to simplify the positioning and guiding of the dispensing device, in one exemplary embodiment at least one stop bar is provided on the dispensing bar by means of which the dispensing device can be positioned and guided on the substrate and/or a wall and/or an edge region of parquet or laminate boards already laid.

An alternative or additional possibility for adapting the dispensing width of the adhesive can be provided by dispensing openings being provided on the dispensing bar which in order to set a dispensing width can be temporarily closed by inserts, in particular flat headed screws.

The object is further achieved according to the invention with a dispensing bar in that the base element is formed by a tube the axial end regions of which are closed, and in that positioning aids in the form of stop bars are provided at the edge regions of the tube.

With the dispensing bar according to the invention the base element is formed by a simple tubular element. The conveyance of the glue from the delivery opening to the surface of the object to be glued no longer takes place through discrete channels. Instead, the glue initially collects within the tube and passes directly from the latter via the dispensing openings onto the component to be glued. The design of the cross-sectional areas of the outlet openings formed in the base element thus determines the form and quantity of the glue or adhesive on the glued surface. For example, the glue can be dispensed onto the object to be glued in the form of round, star-shaped or square strands of glue or adhesive.

By means of the simple structural design the dispensing bar according to the invention can be produced inexpensively. Depending on the choice of material for the dispensing bar the latter can even be in the form of a throw-away part. For example, the tube can be produced from plastic, in particular from PVC. Due to the simple and inexpensive production it is also possible from a financial point of view and also wise in view of the associated saving of time when handling the device to use for objects with glued surfaces with different widths a respective dispensing bar with a base element adapted to this width.

In order to also be able to use the dispensing bar universally in already existing glue or adhesive dispensing devices, with the dispensing bar according to the invention it is only necessary to adapt the delivery opening to the respective connection configuration of the device already available on the market. It is then possible to use the dispensing bar with any glue dispensing device (dispenser) available on the market and also to retrofit it appropriately.

When dispensing the glue or adhesive onto an already laid floorboard the stop bars serve to be brought to rest, and on said board to be moved along, and this contributes to a reproduceable dispensing result and a homogeneous dispensing appearance. Here the stop bars project downwards over the tube so that they form spacing relative to the substrate to be worked on. This embodiment makes it possible to place the dispensing bar on the floor and to bring it to rest against the floor board laterally with the result that it is extremely easy to use the device for dispensing glue.

Preferably a bent metal sheet—in particular U-shaped—can be provided that extends over the tube and has arms projecting laterally downwards from the tube forming the stop bars.

For homogeneous distribution of the glue or adhesive in the space enclosed by the tube a number of delivery openings can be formed on the tube.

The base element can have a round or square, in particular quadratic or also an elliptical cross-section in order to be adapted to the geometry of the area provided with adhesive or glue and to be able to lie on the glued surface to be assembled for example.

In one exemplary embodiment the tube is formed from a number of tube sections interlocking like a telescope which are connected to one another, displaceably in relation to one another, in order to set the dispensing width of the adhesive or the glue. With this embodiment the width of the dispensing bar can be adapted to the width of an object to be glued. In order to be able to guarantee homogeneous dispensing of the glue or adhesive when the tube sections are shifted relative to one another, in a further configuration of this embodiment a grating can be provided on the tube sections. By means of the latter it is achieved that after shifting the tube sections always adopt a position in which the outlet openings lie over one another in a crossover region of the tube sections, and so remain penetrable over the whole extension of the tube.

It has proven to be particularly advantageous if the width of the tube of a dispensing surface of the component to be glued corresponds in particular to a floor board to be glued. If in addition the dispensing openings and the distances between them are also adapted to the different widths of the adhesive dispensing surfaces and different parquet board widths, a particularly homogeneous adhesive application is achieved. Also the dispensing openings can not only be disposed next to one another, but also in a number of rows so as to enable faster and specific material application onto the glued surface.

In one embodiment of the invention the axial end regions are closed by means of caps. These caps can be designed such that they project radially from the tube and so form a spacer in relation to the substrate being worked on. The caps then form the stop bars.

According to one preferred embodiment provision is made such that at least one cap is fixed rotatably onto the tube and has an extension, which is likewise tubular, projecting into the tube, the extension having wall regions which by turning the cap can be brought to overlap the dispensing openings so as to thus reduce the dispensing width. With this embodiment, depending on the rotational position, the cap covers a different number of dispensing openings so that the dispensing width can be set by turning the cap.

With a variation of the embodiment the extension can overlap a predetermined number of dispensing openings and have openings in the extension corresponding to the dispensing openings. Preferably a number of rows of openings are provided here in the extension, the number of which preferably decreases from one row to the next from the outside to the inside. With this embodiment the user sets the dispensing width before placing in operation the dispensing bar by overlapping a desired number of openings in the extension with the dispensing openings by turning the extension.

Alternatively, the tubular extension can also be cut off at an angle so that its extent is of variable length. In this case the cap is turned before placing in operation to such an extent that the desired number of dispensing openings are covered.

Figure 1B:
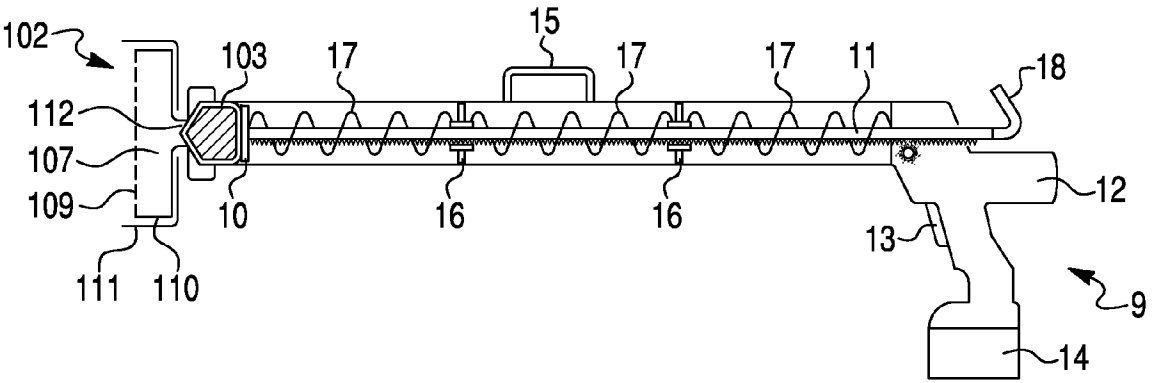
Figure 2:
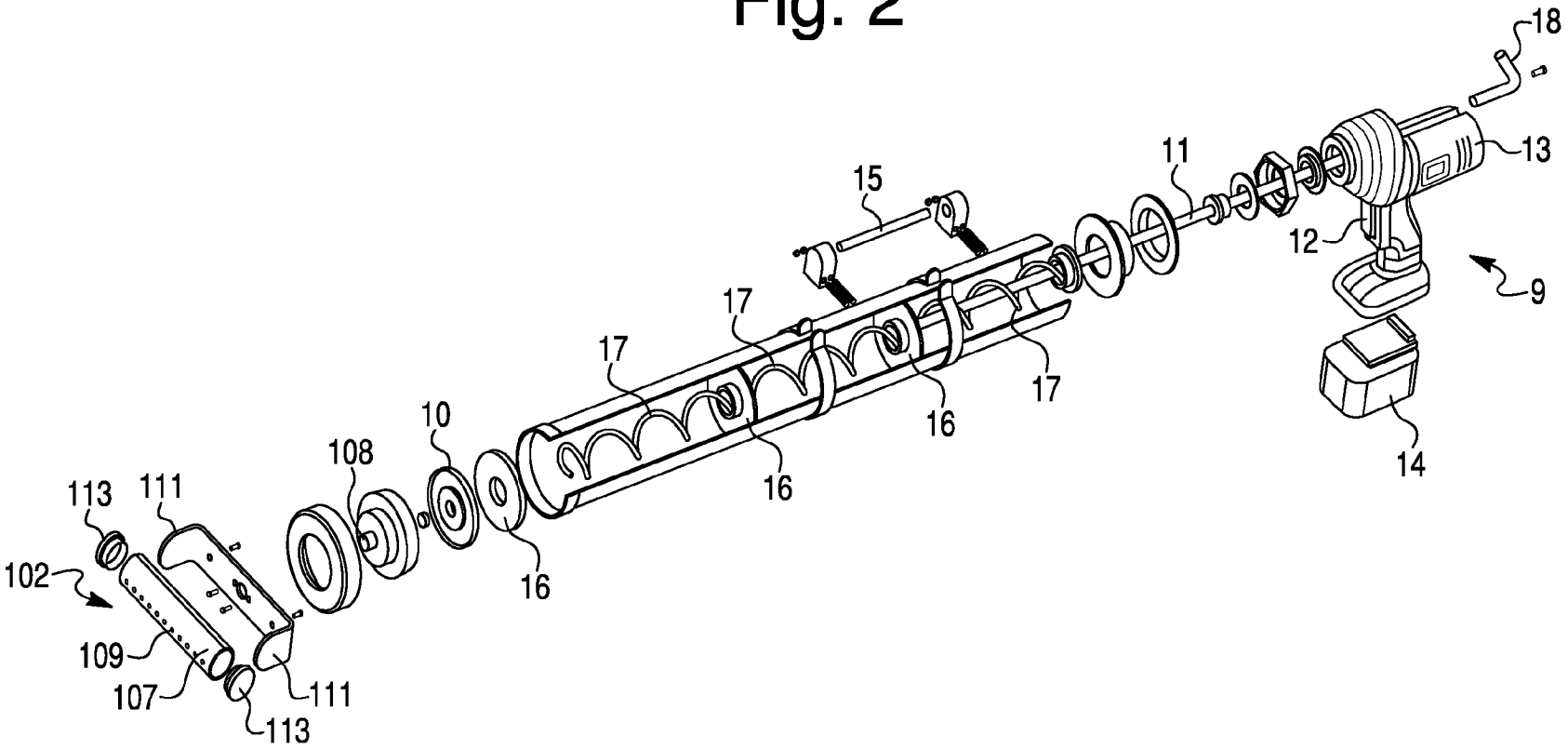
Figure 3:
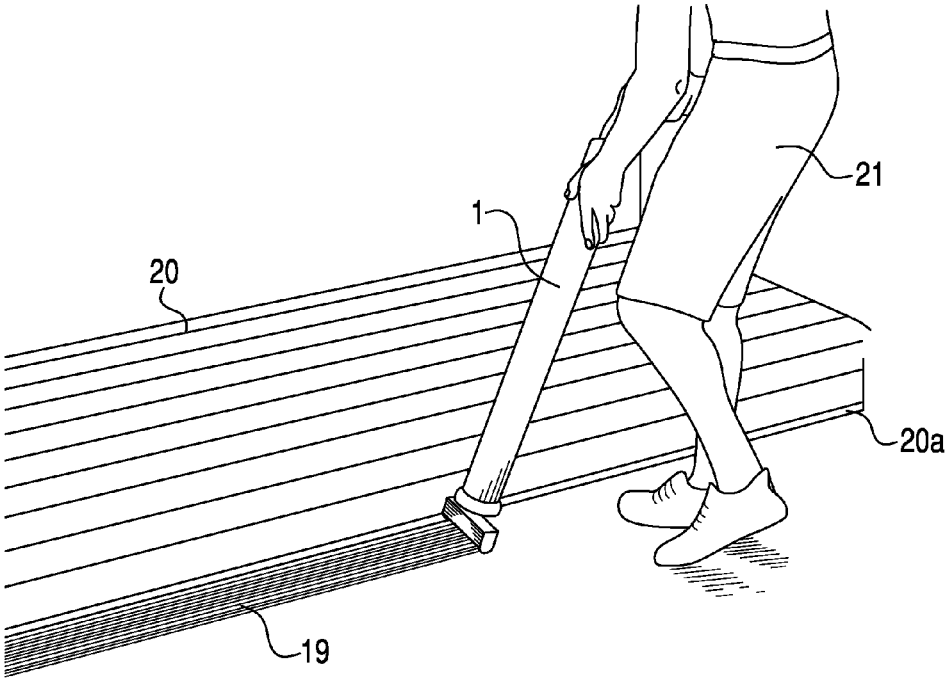
Figure 4:
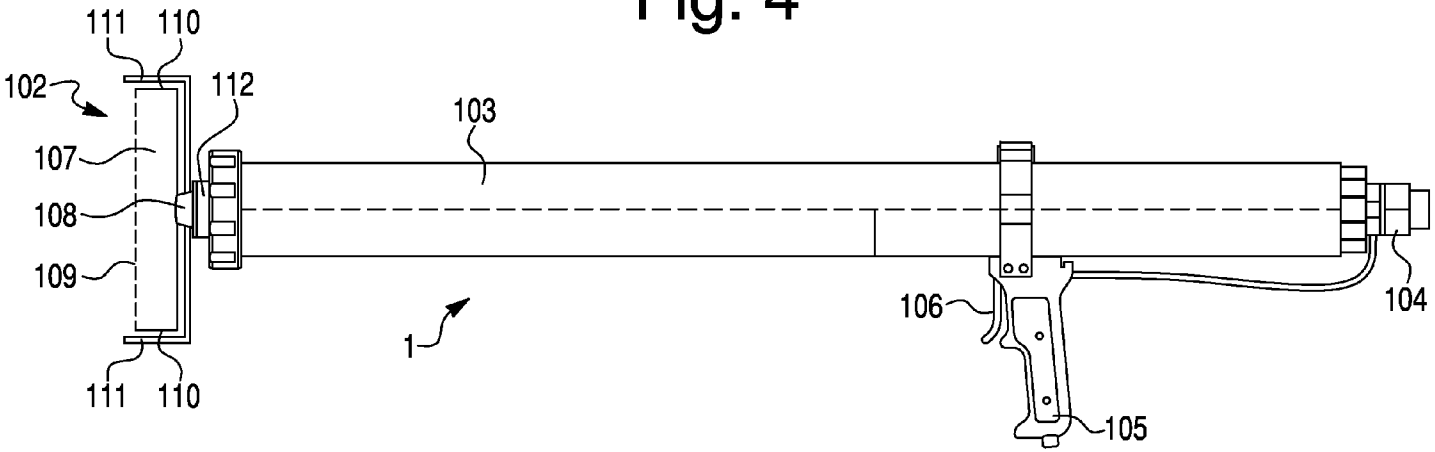
Figure 6:
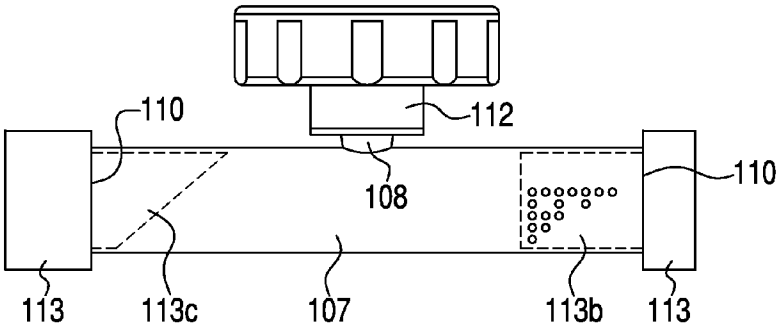
Figure 5:
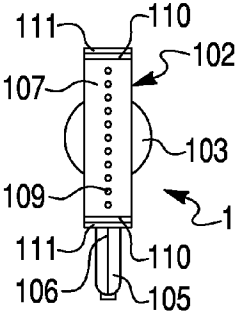

Further advantageous embodiments of the present invention can be gathered from the sub-claims or from the drawings described below. These show as follows:

FIGS. 1*a* and 1*b* a diagrammatic illustration of a dispensing device according to the invention for dispensing glue or adhesive onto a substrate surface;

FIG. 2 a perspective exploded drawing of the dispensing device according to the invention according to FIG. 1;

FIG. 3 a diagrammatic illustration of the dispensing device according to the invention in operation;

FIG. 4 a diagrammatic illustration of a glue dis-pensing device with a dispensing bar according to the invention;

FIG. 5 the glue dispensing device according to FIG. 4 from the right; and FIG. 6 an enlarged partial illustration of the glue dispensing device with two caps.

FIGS. 1*a* and 1*b* show a diagrammatic illustration of a dispensing device 1 for dispensing glue or adhesive for laying or gluing floor coverings, in particular parquet or laminate in board format.

The dispensing device 1 is designed as a free-standing device and has a glue cylinder 103 into which a pouch 3 filled with glue or adhesive is inserted. Adjoining the free end of the glue cylinder—shown on the left in the drawing—is a dispensing bar 102 which is connected to the glue cylinder 2 via a delivery opening 108. The dispensing bar 102 has a base element 107 which has a number of dispensing openings 108 lying next to one another opposite the delivery opening 108. In the exemplary embodiment shown the base element 107 is in the form of a cylindrical tube made of plastic, the axial end regions of which are closed by caps 113. A respective positioning aid in the form of stop bars 111 is respectively provided at the end regions of the base element 107. The stop bars 111 are formed here on a bent metal sheet which is pushed onto the glue cylinder 103 via the delivery opening 108 and is screwed to the base element 107 of the dispensing bar 102.

The interchangeability of the dispensing bar 102 makes it possible to unscrew the dispensing bar 102 with different widths of parquet board for dispensing the adhesive and to replace it with a further dispensing bar 102 with a correspondingly shorter or longer base element 107. Alternatively, it is also possible to provide adaptation of the working width to the width of the parquet boards by temporarily closing individual outlet holes or dispensing openings 109 of the dispensing bar 102 with inserted flat headed screws.

Disposed on the end of the glue cylinder 103 lying opposite the dispensing bar 102 is an electric drive 9 which—as also illustrated in greater detail in FIG. 107—is coupled to an axially moveable plunger 10 disposed in the glue cylinder 2 in order to displace the plunger 10 axially within the glue cylinder 2. The plunger 10 is connected to a toothed rack 11 which extends into the glue cylinder 103 and is guided therein with axial moveability. The toothed rack 11 is coupled to an output shaft (not shown) of the electric drive 9 so that rotation of the output shaft driven by the electric motor is converted into a straight-line axial movement of the toothed rack 11 and the plunger 10.

The toothed rack 11 is connected to a gear mechanism (not detailed) of the electric drive 9. The free end of the toothed rack 11 projects out of a housing 12 surrounding the electric drive 9. The length of the section of the toothed rack 11 projecting out of the housing 12 shows a user the amount of glue or adhesive remaining in the glue cylinder.

The length of the toothed rack 11 is designed, as shown in FIG. 1*b*, such that after reducing the dispensing bar 102 by using an actuating means 13 formed on the housing 12 of the electric drive 9, and so by pushing the toothed rack 11 and the plunger 10 further forward, the squeezed pouch 3 can be pushed out of the glue cylinder 103 without a user having to take hold of the pouch 3.

A rotational speed of the electric motor for moving the toothed rack 11 is set by the actuating means 13. In this way the delivery rate of the glue or adhesive can be adapted to the prevailing operating conditions.

The supply of power to the electric motor of the electric drive 9 is implemented by means of an accumulator 14 connected to the electric motor and fitted in the housing 12. In order to simplify handling the housing 12 of the electric drive 9 is designed in the form of a handle. A further handle element 15 is optionally fastened to the glue cylinder 103 substantially centrally.

In order to stabilise the movement of the toothed rack 11 within the dispensing device 1, in this exemplary embodiment stabilising means 16 in the form of cylinder discs are provided by means of which the toothed rack 11 can be supported on the wall of the glue cylinder 103. The cylinder discs 16 are attached to the toothed rack 11 with axial movement.

In order to further stabilise the toothed rack 11 spacer elements are provided between the stabilising means 16 in order to hold the stabilising means 16 equidistantly along the toothed rack 11. In the present exemplary embodiment the spacer elements are formed by spiral springs 17 which extend axially along the glue cylinder 103.

As a further measure for preventing bending of the toothed rack 11*a* control is provided in the electric drive 9 which limits the current consumption of the electric motor. In this way overloading of the toothed rack 11, the stabilising means 16 and the electric motor is ruled out and the energy yield from the accumulator 14 is maximised.

The gear mechanism provided in the electric drive 9 is in the form of a planetary gear and a flange-mounted angular gear which can be switched manually between an operating position, in which it engages with the toothed rack 11, and a filling position, in which a free axial movement of the toothed rack 11 within the electric drive 9 contrary to the dispensing direction of the glue or adhesive is possible.

Alternatively, it is also possible to switch the gear into a filling position such that it finds itself in a type of idling state if the toothed rack 11 is then drawn manually by means of a filling lever 18 formed on the free end of the toothed rack 11 without expending any great force into a position in which the piston 10 with the glue cylinder 103 comes to rest against its end facing towards the electric drive 9 so as to thus clear the space required for refilling the glue cylinder 103 with a further pouch loaded with glue or adhesive.

FIG. 3 shows a dispensing device 1 according to the invention in operation. The length of the dispensing device 1 in the form of a free-standing device is approx. 115 cm and is chosen such that it enables fatigue-free working and at the same time in the packaged state fits onto a euro-pallet.

In order to enable the most accurate possible positioning and the straightest and most even possible dispensing of beads of adhesive 19 from the openings of the dispensing bar the stop bar 111 is brought by a user to rest against a wall, or as shown here, against an edge 20*a* of strips of parquet board 10 already laid or on the substrate or floor to be worked on, and during dispensing of the adhesive is drawn along the edge 20*a* formed by the wall or board strip and the substrate.

By pressing the actuating means 13 the adhesive is distributed in uniform adhesive beads over the substrate. By means of the actuating means 13 the delivery quantity and delivery speed of the adhesive beads 19 can be varied. If therefore the adhesive beads 19 are distributed not in a straight line but in a meandering form on the substrate, either the delivery output can be reduced by the regulator 13 or the feed speed of the dispensing device 1 can be increased which can be achieved, for example, by faster walking.

FIGS. 4 and 5 show a diagrammatic illustration of a further glue dispensing device 100 for dispensing glue or adhesive to an object to be glued such as for example parquet or laminate boards. The glue dispensing device 100 comprises a dispensing bar 102, a glue cylinder 103 and a compressed air delivery device 104 which can be controlled by means of an actuation lever 106 which is provided on a handle 105 fitted onto the glue cylinder 103.

The dispensing bar 102 has a base element 107 on which a delivery opening 108 and a number of dispensing openings 109 lying next to one another and opposite the delivery opening 108 are formed (see also FIG. 5). In one exemplary embodiment (not shown) the dispensing openings 109 are disposed at an angle of 30°, 45° or 60° relative to the axis formed by a glue cylinder 103.

In the exemplary embodiment shown the base element 107 is designed in the form of a cylindrical tube made of plastic, in this case PVC, the axial end regions 110 of which are closed by caps 113. The width of the tube 107 is chosen here such that it corresponds to the width of the object to be glued.

A respective positioning aid in the form of a stop bar 111 is provided at the end regions 110 of the tube 107. The stop bars 111 are formed here by a bent metal sheet which is pushed onto the glue cylinder 103 by means of a connection nozzle 112 and screwed onto the dispensing bar 102. More specifically, a U-shaped bent metal sheet is provided which extends over the tube 107 and has arms projecting laterally downwards from the tube 107 forming the stop bars 111. As can be seen in particular in FIG. 4 the arms project downwards over the tube 107 in order to form spacing relative to the substrate to be worked on. The arms have on their lower end region a rounded, in this case semi-circle-like form (see FIG. 3).

By means of the stop boards 111 it is possible to dispense the glue or adhesive with precise positioning and evenly. For this purpose the dispensing bar 102 is placed on the floor with its stop bar 111 and laid against a wall or against a floor board already laid and guided along the latter.

The quantity of glue flowing out is determined and controlled here by the size and number of dispensing openings 109, the speed of movement of the device 101 over the surface of the object to be glued and to be assembled along the already laid floor boards and the system pressure applied by the compressed air delivery device 104, among other things dependently upon the viscosity of the adhesive.

The glue cylinder 103 serves to accommodate glue pouches (not shown) in which the glue or adhesive to be applied is stored. In order to apply glue or adhesive the glue pouch is first of all inserted into the glue cylinder such that the glue can flow out of the glue pouch via an outlet opening 112 formed on the glue cylinder 103 into the delivery opening 108 formed in the dispensing bar 102. The dispensing of the glue from the glue pouch from the outlet opening 112 via the delivery opening 108 into the interior of the tube 107 can be implemented, for example, by means of a plunger (not shown) which successively compresses the glue pouch by means of compressed air from the compressed air delivery device 104 (not shown).

If the interior of the tube 107 is totally filled with glue, further delivery of the glue from the glue pouch ensures that the glue passes automatically homogeneously out of the dispensing openings 109 of the tube 107 onto the object to be glued according to the width of the tube 107 and the arrangement of the dispensing openings 109 disposed therein.

FIG. 6 shows an enlarged partial illustration of an alternative dispensing bar for a glue dispensing device 101. With this embodiment the axial ends of the tube 107 are closed by two caps 113. The latter project radially in relation to the tube diameter 107 and so guarantee a predetermined distance from the substrate to which the glue is to be applied. At the same time the outer face surfaces form the stops on the cap side by means of which the dispensing bar 102 can be positioned laterally.

As can be seen easily in FIG. 6 the caps 113 respectively have an extension 113*a*, 113*b*, also tubular in form, projecting into the tube 107, the extensions 113*a*, 113*b* having wall regions which by turning the cap 113 are brought to overlap with the dispensing openings 109 so as to thus reduce the dispensing width. For this purpose, in a simple way the extension 113*a* of the cap 113 on the left in the drawing is cut off at an angle, the position shown defining the maximum dispensing width, whereas with a cap 113 turned about 180° the extension 113*a* covers the maximum possible number of dispensing openings 109.

With the cap 113 on the right in the drawing the extension 113*b* has a length that is constant over its extent. For this purpose a number of rows of openings 114 are provided in the extension 113*b*, the number of openings 114 decreasing from one row to the next from the outside to the inside. In the position shown the maximum possible number of dispensing openings 109 are covered by the extension 113*b*. By turning in an anticlockwise direction the dispensing width is continuously increased.

The invention claimed is:

1. A dispensing bar (102) for dispensing glue or adhesive onto a substrate surface, comprising:

a base element (107) including at least one delivery opening (108) and a number of dispensing openings (109) disposed lying next to one another and formed opposite the delivery opening (108) the base element (107) formed by a tube having closed axial end regions (110); and a positioning aid comprising a planar sheet and stop bars (111) coupled to the planar sheet;

wherein a portion of the planar sheet is disposed behind the tube and the stop bars (111) projecting beyond the tube (107) so that they form spacing relative to the substrate to be worked on.

2. The dispensing bar according to claim 1, wherein the positioning aid is a bent metal sheet.

3. The dispensing bar according to claim 1, wherein the axial end regions (110) are closed by caps (113).

4. The dispensing bar according to claim 1, wherein the tube (107) is formed from a number of tube sections interlocking like a telescope which are connected to one another displaceably in relation to one another in order to set the dispensing width of the adhesive or the glue.

5. The dispensing bar according to claim 1, wherein the width of the tube (107) corresponds to the width of a floor board.

6. The dispensing bar (102) according to claim 1, wherein the dispensing openings (109) are provided on the dispensing bar (102), the dispensing openings (109) are temporarily closable in order to set a dispensing width by means of inserts.

7. The dispensing bar (102) according to claim 1, wherein the tube is a hollow elongated structure.

8. The dispensing bar (102) according to claim 1, wherein the tube is a hollow elongated cylindrical.

9. The dispensing bar (102) according to claim 8, wherein the tube is arranged transverse to the planar sheet of the positioning aid.

10. The dispensing bar (102) according to claim 1, wherein the positioning aid is made of a first material and the tube is made of a second material different from the first material.

11. The dispensing bar (102) according to claim 10, wherein the positioning aid is made of metal and the tube is made of PVC.

12. The dispensing bar (102) according to claim 1, wherein the positioning aid further comprises an opening formed in the planar sheet wherein the delivery opening (108) aligns within the opening formed in the planar sheet of the positioning aid.

13. The dispensing bar (102) according to claim 1, wherein the tube is removably coupled to positioning aid.

* * * * *